United States Patent [19]

Ognier et al.

[11] 4,344,663

[45] Aug. 17, 1982

[54] CONNECTOR-LOCKING DEVICE

[75] Inventors: Paul Ognier, Lannion; Bernard Guilchier, Morlaix, both of France

[73] Assignee: Compagnie Industrielle des Telecommunications Cit-Alcatel, Paris, France

[21] Appl. No.: 138,313

[22] Filed: Apr. 8, 1980

[30] Foreign Application Priority Data

Apr. 25, 1979 [FR] France ..... 79 10463

[51] Int. Cl.[3] ..... H01R 13/62

[52] U.S. Cl. ..... 339/75 M; 339/91 R

[58] Field of Search ..... 339/39, 75 R, 75 M, 339/91 R, 126 R

[56] References Cited

U.S. PATENT DOCUMENTS 3,239,795 3/1966 Verrone ..... 339/91 R 3,977,748 8/1976 Gruhn et al. ..... 339/75 M 4,077,693 3/1978 Briel et al. ..... 339/126 R

FOREIGN PATENT DOCUMENTS 2355656 5/1974 Fed. Rep. of Germany .... 339/91 R 2220893 4/1974 France .

2206032 5/1974 France ..... 339/91 R

*Primary Examiner*—Joseph H. McGlynn

*Assistant Examiner*—Frank H. McKenzie, Jr.

*Attorney, Agent, or Firm*—Kenyon & Kenyon

[57] ABSTRACT

A locking device for a two part plug-in connector comprises two separate locking pieces (10,20), one mounted on one part of the connector and including hooks, the other mounted on a second part of the connector and comprising hook-receiving notches. One or other of the locking pieces (10,20) is movable relative to its connector part.

4 Claims, 3 Drawing Figures

CONNECTOR-LOCKING DEVICE

The present invention relates to electrical connectors of the type comprising two plug-in parts.

BACKGROUND

In general, one part of a connector comprises a plurality of male contacts cooperating with female contacts in the other part. If one of the parts of the connector is generally fixed (at the back of a rack for example), the other part is held only by cooperation between the contacts. This second part, which is subjected to the weight of the cable to which it is joined, may come loose from the first part, either due to an impact or because of incorrect plugging in.

OBJECT OF THE INVENTION

One object of the invention is to provide a locking device which prevents connectors from opening unexpectedly and provides satisfactory engagement.

Another object of the invention is to provide a locking device which, besides its function of clamping the parts of the connector, also acts as an index, so as to prevent the parts of the connector from being joined in erroneous fashion.

BRIEF SUMMARY OF THE INVENTION

The present invention provides a device for locking a connector comprising a first part and a second part, one of the parts carrying contacts of a first type for cooperating with contacts of a second type carried by the other part, the connection being made by bringing a first face of one part close to a second face of the other part, wherein the first part includes a first locking piece equipped with hooked members extending perpendicularly to two edges of the first face towards the exterior of the part, said locking piece being capable of moving with respect to the first part parallel to said edges and being restored to a fixed position by a spring, the second part including a second locking piece, fixed with respect to the second part, disposed in the vicinity of the second face and comprising apertures having a shape complementary to that of the hooked members.

Alternatively the hooked locking piece may be fixed with respect to its connector part, while the locking piece with hook-receiving apertures is capable of moving with respect to its connector part.

BRIEF SUMMARY OF THE DRAWINGS

The invention will be clearly understood from the description given hereinafter of a preferred embodiment with reference to the accompanying appended drawings, in which.

DETAILED DESCRIPTION

Figure 1:
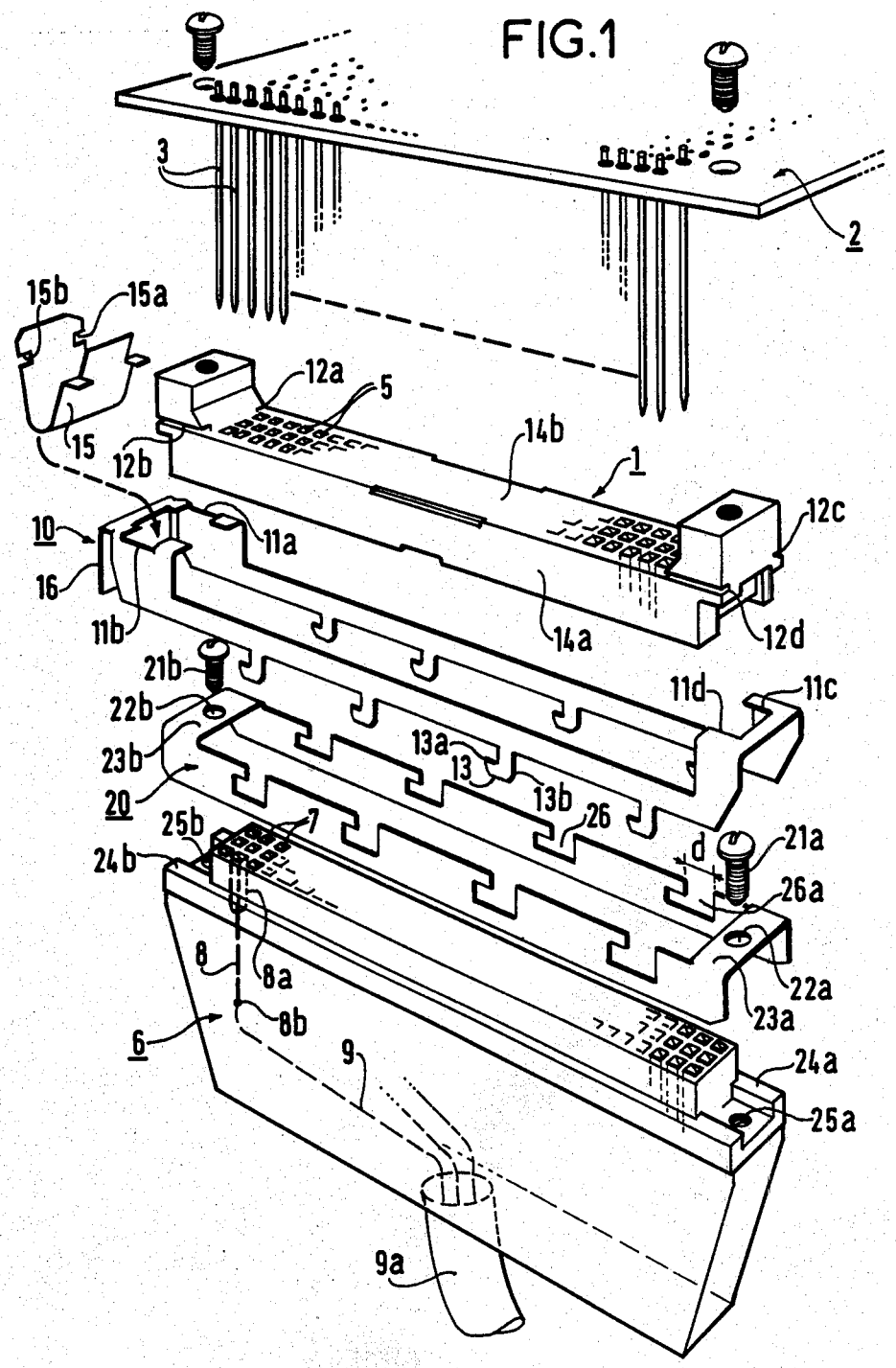
FIG. 1 is an exploded view of a connector equipped with a locking device in accordance with the invention.

FIG. 1 is an exploded view of the various components of a connector and of a locking member in accordance with the invention.

This example is a connector of which one of the parts, here the part bearing the reference 1, is fixed to a rack 2.

The rack is a printed circuit board. The board may be horizontal or vertical. Pins such as 3 pass through the board and the connector part 1 by way of holes such as 5. The part 1 of the connector, taking the form of a box inside which the pins 3 project, is intended to be joined to another part 6 including cavities 7 corresponding to the pins 3; at the bottoms of these cavities there are pins 8 whose ends 8*a* cooperate with the pins 3 in order to make the electrical contact, and whose other ends are joined to wires 9 combined to form a cable 9*a* which emerges from the part 6.

In order to lock this connector, its parts 1 and 6 are equipped with respective first and second locking members.

The first locking member, bearing as a whole the reference 10, is a metal piece fitted round the part 1 and comprising slides such as 11*a* to 11*d* capable of sliding in grooves 12*a* to 12*d* in the part 1. Hooked members such as 13 extend parallel to two large faces 14*a* and 14*b* of the part 1, and extend beyond the edges of this part.

A spring in the form of a bent resilient metal strip 15 bears both against one end of the part 1 and against a folded-over portion 16 of the piece 10.

It is held in place by lugs 15*a* and 15*b* which bear against the slides 11*a* and 11*b* respectively.

The second locking member, bearing the reference 20, is a piece surrounding the connector part 6, in the vicinity of the face facing the element 1. This piece is fastened to the part 6 by means of screws 21*a* and 21*b* passing through orifices 22*a* and 22*b* in transverse lugs 23*a* and 23*b* on the piece. The lugs rest on shoulders 24*a* and 24*b* on the part 6, which shoulders are provided with holes 25*a* and 25*b* to receive the screws 21*a* and 21*b*.

At its sides, the piece 20 includes notches 26 intended to cooperate with the hooked members 13. The size d of the aperture 26*a* of the notch is just slightly greater than the length of the hook taken from its toe 13*a* to its heel 13*b*, so as to enable the hooks to engage in the notches.

Figure 2A:
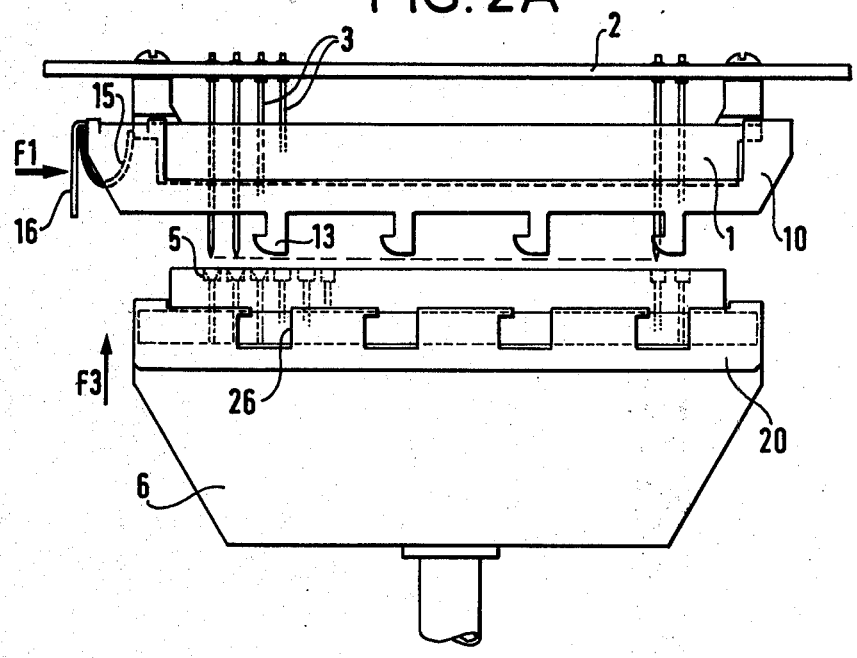
FIGS. 2*a* and 2*b* illustrate operation during connecting and locking.
Figure 2B:
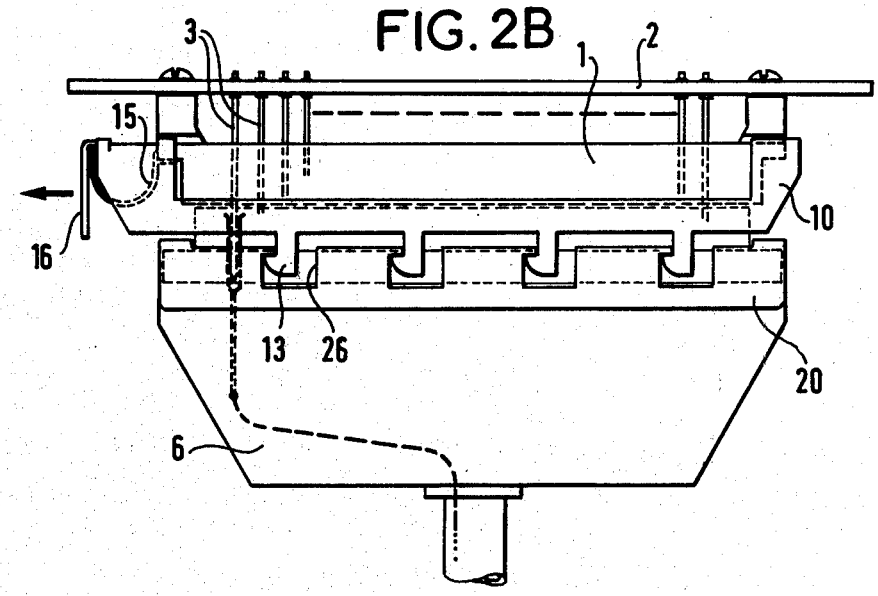

The manner in which the connector is used is illustrated in FIGS. 2*a* and 2*b*.

In order to join the two parts 1 and 6 of the connector, pressure is applied to the locking member 10 in the direction of (arrow $F_1$ in FIG. 2*a*), so that when the cavities 7 come into position facing the pins 3, the hooks 13 are facing the notches 26 and can enter therein.

The two parts of the connector are brought close together (arrow $F_3$), and then (FIG. 2*b*) the pressure on the locking member 10 is relaxed. Each hook then enters the central part of the corresponding notch.

It will be noted that the shape of the hooks enables introduction and locking to be automatic.

It will be noticed that the arrangement of the hooks and notches provides additional security, since it is impossible to connect the two elements of the connector the wrong way round.

In the example described, it is the part having hooks which is capable of moving in translation; naturally the part having notches could be movable, with the part having hooks then being fixed.

We claim:

1. A device for locking an electrical connector having a first part including a face, which is provided with contacts of a first type, and two sides, which are parallel to each other and perpendicular to said face, and a second part including a face, which is provided with contacts of a second type for cooperating with the contacts of the first type when the face of the second part is brought close to the face of the first part, wherein the locking device comprises:

each of said sides of said first part having a groove located at each end and extending parallel to the face of said first part;

a first locking piece consisting of a one-piece channel-shaped member;

means for mounting the first locking piece on said first part for slidable translation in a direction parallel to said face between a locking position and an unlocking position, said means for slidably mounting the first locking piece on the first connector part comprising two pairs of tabs formed integrally with said channel-shaped member, one pair adjacent to each end thereof, the tabs of each pair being inserted into the respective grooves at the corresponding end of the first connector part;

spring means interposed between the first part and the first locking piece for biasing said first locking piece into the locking position;

a second locking piece mounted on said second part, one of said first and second locking pieces having two spaced apart edges parallel to the corresponding face of the respective part with hooked members extending from said edges perpendicularly to and outwardly of the plane of the corresponding face, and the other of said locking pieces having apertures corresponding to said hooked members, each aperture having a shape complementary to that of the corresponding hooked member;

and means for fastening the second locking piece in fixed relation to said second connector part.

2. A locking device according to claim 1 wherein said first locking piece is equipped with the hooked members, and the second locking piece is provided with the apertures.

3. A locking device according to claim 1 wherein the second connector part contains at least one tapped hole, the second locking piece includes a hole aligned with the tapped hole in the second part, and the means for fastening the second locking piece to the second part comprises a screw passing through the hole in the second piece and threadably engaged in the tapped hole in the second part.

4. A locking device according to claim 1 wherein the spring means comprises a metal strip bent into an approximately U-shape positioned between one end of the first connector part and the adjacent end of the first locking piece, one arm of said U having a pair of integral tabs inserted into the corresponding grooves at said one end of the first connector part and the other arm of said U having a pair of lugs on the opposite side edges of said strip, and the first locking piece comprises a notched opening for lockingly receiving said other arm of the spring means.

* * * * *